US008827426B2

(12) United States Patent
Xiao et al.

(10) Patent No.: US 8,827,426 B2
(45) Date of Patent: Sep. 9, 2014

(54) IMAGING DEVICE, METHOD OF REMODELING IMAGING DEVICE, AND CONSUMABLES CONTAINER FOR IMAGING DEVICE

(75) Inventors: Qingguo Xiao, Guangdong (CN); Qiang Zhang, Guangdong (CN)

(73) Assignee: Print-Rite Technology Development Co., Ltd. of Zhuhai, Guangdong (CN)

( * ) Notice: Subject to any disclaimer, the term of this patent is extended or adjusted under 35 U.S.C. 154(b) by 0 days.

(21) Appl. No.: 13/878,997

(22) PCT Filed: Jun. 22, 2011

(86) PCT No.: PCT/CN2011/076108

§ 371 (c)(1),
(2), (4) Date: Apr. 11, 2013

(87) PCT Pub. No.: WO2012/048586

PCT Pub. Date: Apr. 19, 2012

(65) Prior Publication Data

US 2013/0187997 A1 Jul. 25, 2013

(30) Foreign Application Priority Data

Oct. 15, 2010 (CN) ..... 2010 1 0510617

(51) Int. Cl.

| | |
|---|---|
| ***B41J 2/14*** | (2006.01) |
| ***G03G 15/00*** | (2006.01) |
| ***B41J 2/175*** | (2006.01) |

(52) U.S. Cl.

CPC ..... *B41J 2/1752* (2013.01); *G03G 15/55* (2013.01); *G03G 2221/1663* (2013.01); *B41J 2/17546* (2013.01); *G03G 15/553* (2013.01)

USPC ..... 347/50; 347/49

(58) Field of Classification Search

USPC ..... 347/7, 19, 49, 50, 85, 86, 87

See application file for complete search history.

(56) References Cited

U.S. PATENT DOCUMENTS

| | | | | |
|---|---|---|---|---|
| 5,365,312 | A * | 11/1994 | Hillmann et al. | 399/12 |
| 5,788,388 | A * | 8/1998 | Cowger et al. | 400/703 |
| 6,158,837 | A * | 12/2000 | Hilton et al. | 347/19 |
| 7,267,415 | B2 * | 9/2007 | Saruta | 347/7 |
| 2005/0206695 | A1 | 9/2005 | Liu | |
| 2009/0058958 | A1 | 3/2009 | Wang | |

FOREIGN PATENT DOCUMENTS

| | | |
|---|---|---|
| CN | 200941148 | 8/2007 |
| CN | 201086453 | 7/2008 |

(Continued)

OTHER PUBLICATIONS

International Search Report dated Sep. 9, 2011.

*Primary Examiner* — Anh T. N. Vo

(74) *Attorney, Agent, or Firm* — Cozen O'Connor

(57) ABSTRACT

The imaging device has a housing inside which a machine body is installed, a consumables container receiver, and a connector. The machine body has a master control circuit board; the master control circuit board has a communications module which communicates with a consumables chip. The consumables chip stores the information relating to a consumables container. At least one consumables container is detachably installed on the consumables container installer of the consumables container receiver. The connector is installed apart from the consumables container installer; the consumables chip is installed inside the connector and connected with a communications module in a communication manner. The invention also provides a remodeling method and a consumables container for such an imaging device.

15 Claims, 21 Drawing Sheets

(56) References Cited

FOREIGN PATENT DOCUMENTS

| | | |
|---|---|---|
| CN | 101817258 | 9/2010 |
| CN | 201693842 | 1/2011 |
| CN | 102009530 | 4/2011 |
| CN | 201841755 | 5/2011 |

* cited by examiner

IMAGING DEVICE, METHOD OF REMODELING IMAGING DEVICE, AND CONSUMABLES CONTAINER FOR IMAGING DEVICE

CROSS-REFERENCE TO RELATED APPLICATIONS

This application claims the priority from international application No. PCT/CN2011/076108 filed on Jun. 22, 2011, which claims priority from Chinese patent application No. 201010510617.X filed on Oct. 15, 2010. These applications are incorporated herein by reference.

FIELD OF THE INVENTION

The invention relates to an imaging device. The invention also relates to a method for remodeling an existing imaging device. Furthermore, the invention relates to a consumables container for the remolded imaging device.

BACKGROUND OF THE INVENTION

As a result of developments in science and technology, the imaging device advanced from the early copy machine, facsimile machine, ink-jet printer and laser printer to an integrated device having multiple functions. A variety of imaging devices use either ink or toner as consumables to form images on paper or other media.

From their structures, various imaging devices comprise a machine body and a housing which essentially seals off the machine body. This means, when the imaging device is working, the housing prevents people from improperly touching the machine body and prevents dirt from passing the housing to enter into the machine body to interfere with normal operation. Machine body means integrated machine components which comprise mechanical components for imaging and electronic components for controlling and operating the mechanical components.

The consumables are contained in consumables containers. The consumables container is detachably installed on the consumables container installer of the machine body and provides the imaging device with consumables needed for image formation. Different imaging devices have different types of consumables container installers; they can be those which do not move in relation to the consumables container installers, such as toner cartridges of copy machines and black-white laser printers; they can also be those which move in relation to the consumables container installers such as printing vehicle of some desktop inkjet printers and toner cartridges of some laser color printers.

The number of consumables containers of an imaging device depends on the image colors of the imaging device. A black-white imaging device usually needs only one consumables container, while a color imaging device needs a number of different color consumables containers depending on the color of the image to be formed on the media according to the color formation principle.

To meet the requirements on image quality and image formation speed, one type of imaging device may have different models; each model uses a specified consumables container and special consumables. To ensure quality, it is necessary that a given imaging device uses a corresponding consumables container. Therefore, many imaging devices have identification systems which not only tell whether the consumables containers are compatible with the imaging devices, but also record and calculate the remaining amounts of the consumables inside the consumables containers. When the remaining amount is lower than a given value, the identification system gives a signal to change the consumables container. Information relating to the consumables containers and consumables are stored by consumables chips. Current consumables chips are installed on the outside walls of consumables containers. When a consumables container is installed on a consumables container installer, the electrode terminals inside the consumables container installer will communicate with a communications module of the imaging device.

The electric components of the imaging device include a master control circuit board. The master control board has a central treatment device, control modules and communications module. The communications module is used to communicate with the consumables chip; communication can be by wire or wireless such as radio frequency, infrared, and Bluetooth. Therefore, in a broad sense of this invention, the electronic components inside the consumables container installer of this invention should include the electrical contact, radio frequency antenna, infrared and Bluetooth receiving and dispatching windows.

With the development of environmental protection, people now refill consumables containers and then reuse them. Information stored in the consumables chips can be reset for new consumables containers.

There are many methods for manufacturing and resetting the resetting chips, including automatic resetting chips such as those disclosed by the Chinese Invention Patent Application No. 101362401A and manual resetting chips such as those disclosed by Chinese Utility Model Patent Application No. 201109239Y. The resetting of the manual resetting chips is performed by a resetting switch. To avoid any improper touching of the resetting switch and mistakenly resetting, a lock switch can be installed in a place apart from the resetting switch and the lock switch and the resetting switch must be pushed down simultaneously to reset the consumables chip.

See FIG. 1. FIG. 1 is a three-dimensional view of a current color inkjet printer 100.

See FIG. 2. After the top cover and paper platform of color inkjet printer 100 in FIG. 1 are removed, one can see sliding bar 110 and printing vehicle 120, which is used as a consumables container installer and can be driven by a motor to slide along sliding bar 110. The consumables container comprises four different color ink cartridges 150, which can be detachably installed inside printing vehicle 120. Four sets of electrode terminals (not shown in FIG. 2) are installed on a low part of inner wall 121 of printing vehicle 120. The bottom part of printing vehicle 120 is equipped with a piezoelectric printing head and four tubular ink supply needles. A wall of each ink cartridge 150, corresponding to the inner wall 121, is equipped with a consumables chip; the bottom wall of each ink cartridge 150 is equipped with an ink supply port which connects to the corresponding ink supply needle. After the ink cartridge 150 as shown in FIG. 2 is installed on printing vehicle 120, the contacting points of the four consumables chips are connected with the four sets of electrode terminals on the inner wall of the printing vehicle; each ink supply needle inserts into the ink supply port of the corresponding ink cartridge; and thus the ink flows to the printing head outlet. There are two flat cables between master circuit board 130 and printing vehicle 120. Cable 141 connects the four sets of electrode terminals on inner wall 121 and the communications module on master circuit board 130 to perform data communication between the printer and ink cartridge. Cable 142 connects the piezoelectric printing head control module of the master circuit board with the piezoelectric printing head to achieve the inkjet control and form image on paper or other media.

Another current inkjet printer is shown in FIG. 4. FIG. 4 shows a three-dimensional view of a current color inkjet printer 200.

See FIG. 5. After the top cover and paper platform of the color inkjet printer in FIG. 4 are removed, one can see sliding bar 210 and printing vehicle 220 as a consumables container installer which can be driven by a motor to slide along sliding bar 210. The consumables container comprises five different color ink cartridges 250 which can be detachably installed inside printing vehicle 220. Five sets of electrode terminals (not shown in FIG. 5) are installed on a low part of inner wall 221 of printing vehicle 220. A wall of each ink cartridge 250, corresponding to the inner wall 221, is equipped with a consumables chip (not shown in FIG. 5). The bottom part of each of the ink cartridges is equipped with a thermal bubble printing head. After ink cartridge 250 as shown in FIG. 5 is installed on printing vehicle 220, the contacting points of five consumables chips are connected with five sets of electrode terminals on inner wall of the printing vehicle 220; and thus the printing head sprays inks onto the paper or other media under the control of the inkjet printer. The flat cables between master circuit board 230 and printing vehicle 220 include a cable which connects five sets of the electrode terminals on inner wall 221 and the communications module of master control circuit board 230 to achieve the data communication between the printer and the ink cartridge and a signal cable for master control circuit board 230 to control the printing head to spray ink.

Another current inkjet printer is shown in FIG. 7. FIG. 7 shows a three-dimensional view of current color inkjet printer 300.

See FIG. 8. When the top cover and some other parts are removed, one can see the consumables container installer which is located on a frame inside the housing. The consumables container comprises six different color ink cartridges 350 which are detachably installed on the consumables container installer. Six sets of electrode terminals (not shown on FIG. 8) are installed on an inner wall of the consumables container installer. Consumables chips (not shown on FIG. 8) are installed on the walls, corresponding to the electrode terminals, of each of ink cartridges 350. There are an ink outlet and an air inlet on the walls of the ink cartridges on which the consumables chips are installed.

See FIG. 9. FIG. 9 shows that when ink cartridges 350 shown in FIG. 8 are placed on the consumables container installer, the contacting points of the six consumables chips are electrically connected with the six electrode terminals on the inner walls of the consumables container installer. The flat cables between the communications module of master circuit board 330 and six electrode terminals on the consumables container installer include cable 341 and cable 342 which perform the data transfer between the printer and the ink cartridges. For clarity, FIG. 9 omits other cables by which master circuit board 330 controls the printer and other components.

A current color laser printer is shown on FIG. 12. FIG. 12 shows a three-dimensional view of color laser printer 400.

See FIG. 13. When the top cover and some other parts of the laser printer in FIG. 12 are removed, one can see the consumables container installer which is located on a frame inside the housing. The consumables container comprises four different color toner cartridges 450 which are detachably installed on the consumables container installer. Four sets of electrode terminals (not shown on FIG. 13) are installed on the inner wall of the consumables container installer. Consumables chips (not shown on FIG. 13) are installed on the walls, corresponding to the electrode terminals, of each toner cartridge 450. Each of the electrode terminals are connected with the communications module of the master circuit board 430. Each toner cartridge is equipped with a toner outlet to supply toner to the laser printer.

See FIG. 14. FIG. 14 shows that when toner cartridges 450 are placed on the consumables container installer, the contacting points of the four consumables chips are electrically connected with the six electrode terminals on the inner walls of the consumables container installer to satisfy signal transmission between them. The toner outlet connects with the toner supply of the consumables container installer and supplies toner under the control of the laser printer. The flat cables between master circuit boards 430, 431 and the electrode terminals on the consumables container installer include cable 441 and cable 442 which perform the data transfer between the laser printer and the toner cartridges. For clarity, FIG. 14 omits other cables by which master circuit boards 430, 431 controls the printer and other components.

A current copy machine is shown in FIG. 17. FIG. 17 shows a three-dimensional view of copy machine 500.

See FIG. 18. When the side walls and some other parts of the copy machine in FIG. 17 are removed, one can see the consumables container installer which is located on a frame inside the housing. The consumables container comprises only one black-white toner cartridge 550 which are detachably installed on the consumables container installer. An electrode terminal (not shown in FIG. 18) which has a radio frequency antenna is installed on the inner wall of the consumables container installer. A consumables chip (not shown on FIG. 18) is installed on the wall, corresponding to the electrode terminals, of toner cartridge 550. The toner cartridge 550 is equipped with a toner outlet to supply toner to the copy machine.

See FIG. 19. FIG. 19 shows that when toner cartridge 550 is placed on the consumables container installer, the antenna of consumables chip 510 is relatively close to radio frequency antenna terminal 511 to satisfy the signal transmission between them. The toner outlet connects with the toner supply of the consumables container installer and supplies toner under the control of the laser printer. Between the communications module of master circuit board 530 and electrode terminal 511 having a radio frequency antenna on the consumables container installer, there is flat cable 541 which performs the data transfer between the copy machine and the toner cartridge 550. For clarity, FIG. 19 omits other cables by which master circuit board 530 controls the copy machine and other components.

Technical Problem

The above imaging devices have a common feature: the communications module connects with the electrode terminal on the consumables container installer and the consumables chip is attached to the consumables container. Therefore, each consumables container, hew or recycled, must have a consumables chip. This design requires a large number of consumables chips and results in expensive consumables containers.

Solution to the Technical Problem

A main objective of the invention is to provide an imaging device which uses fewer consumables chips and has reduced consumables costs.

Another objective of the invention is to provide a method for remodeling current imaging devices which use high-cost consumables containers into imaging devices which use the consumables containers having reduced costs.

Still another objective of the invention is to provide a consumables container for use in an imaging device which uses a consumables container having reduced costs.

To achieve the above objectives, this invention provides an imaging device which comprises a housing; a machine body is installed inside the housing; the machine body comprises a master control circuit board; the master control circuit board comprises a communications module for communication with a consumables chip; a consumables container installer is installed inside the machine body which can be used to detachably install one or more consumables containers; and a consumables chip that stores the information relating to the consumables container. In addition, a connector is installed apart from the consumables container installer, and the consumables chip is installed on the connector and communicates with the communications module.

A preferred scheme of the invention is as follows. The connector comprises a box. The box is fixed on a wall of the housing of the imaging device. The consumables chip can be a resetting chip. A resetting switch of the resetting chip is placed on a wall of the box or on a wall of the housing. The box can be fixed on an inner wall of the housing and the resetting switch of the resetting chip is then placed on a wall of the housing for convenience of the operation. The box can also be fixed on an outside wall of the housing and the resetting switch is then placed on a wall of the box for operational convenience.

A detailed scheme of the invention is as follows. The consumables container installer is a printing vehicle. The printing vehicle has an ink supply needle. The consumables container is an ink cartridge having an ink supply port. The ink cartridge is detachably installed inside the printing vehicle so that the ink supply port and the ink supply needle have a fluid connection.

Another detailed scheme of the invention is as follows. The consumables container installer is a printing vehicle. The consumables container is an ink cartridge having a printing head. The ink cartridge is detachably installed inside the printing vehicle.

Still another detailed scheme of the invention is as follows. The consumables container installer is placed on the machine body inside the housing. There is a consumables container installation port in the corresponding position of the consumables container installer. The consumables container is an ink cartridge. The ink cartridge is detachably installed on the consumables container installer via the consumables container installation port.

The invention also provides a method for remodeling current imaging devices. Prior to remodeling, the imaging device comprises a housing; a machine body is installed inside the housing; the machine body comprises a master control circuit board; the master control circuit board comprises a communications module which communicates with a consumables chip; the machine body also comprises a consumables container installer; one or more consumables containers are detachably installed on the consumables container installer; the consumables chip stores information relating to the consumables container and is fixed on an outside wall of the consumables container; the consumables container is equipped with an electrode terminal which is electrically connected with the communications module. The remodeling method comprises installing a connector in a place which is apart from the consumables container installer; breaking the electrical connection between the communications module and the electrode terminal; and installing the consumables chip in the connector which communicates with the communications module.

A preferred scheme of the invention is as follows. The connector is a box. The box is fixed on a wall of the housing of the imaging device. The consumables chip inside the connector box can be a resetting chip. A resetting switch of the resetting chip is placed on a wall of the box or the housing. The box can be installed on an inner wall or an outside wall of the housing of the imaging device. If a new consumables chip is used as an automatic resetting chip, the box is preferably installed on an inner wall of the housing in order to reduce the size of the imaging device. If a manual resetting chip is used, it can be installed on either an inner wall or an outside wall of the housing provided that the operation of the resetting switch, which is either on a wall of the box or the housing, is convenient.

A detailed scheme of the invention is as follows. The consumables container installer is a printing vehicle. The printing vehicle has an ink supply needle. The consumables container is an ink cartridge having an ink supply port. The ink cartridge is detachably installed inside the printing vehicle so that the ink supply port and the ink supply needle can have fluid connection.

Another detailed scheme is as follows. The consumables container installer is a printing vehicle. The consumables container is an ink cartridge which has a printing head. The ink cartridge can be detachably installed inside the printing vehicle.

Still another detailed scheme of the invention is as follows. The consumables container installer is on the machine body. A consumables container installation port is on the housing corresponding to the position of the consumables container installer. The consumables container is an ink cartridge. The ink cartridge is detachably installed on the consumables container installer via the consumables container installation port.

The invention also provides a consumables container which can be detachably installed on the consumables container installer of imaging devices. The imaging device comprises a housing and a machine body inside the housing. The machine body comprises a master control circuit board. The master control circuit board comprises a communication module which communicates with a consumables chip. The consumable chip stores information relating to the consumables container. A connector is placed apart from the location of the consumables container installer. The consumables chip is installed inside the connector and communicates with the communication module.

A preferred scheme of the invention is as follows. The consumables chip is a resetting chip. The connector is a box and the resetting switch of the resetting chip is on an accessible wall of the box or the housing.

A detailed scheme of the invention is as follows. The consumables container installer is a printing vehicle. The printing vehicle has an ink supply needle. The consumables container is an ink cartridge having an ink supply port. The ink cartridge is detachably installed inside the printing vehicle so that the ink supply port and the ink supply needle can have fluid connection.

Another detailed scheme of the invention is as follows. The consumables container installer is a printing vehicle. The consumable container is an ink cartridge having a printing head. The ink cartridge is installed inside the printing vehicle.

Still another detailed scheme of the invention is as follows. The consumables container installer is installed on the machine body inside the housing. The housing has a consumables container installation port on a location corresponding to the consumables container installer. The consumables container is an ink cartridge which is detachably installed on the consumables container installer via the consumables container installation port.

Effectiveness of the Invention

As indicated in the above schemes, according to this invention, the consumables container and the consumables chip are placed apart; the consumables chip is installed inside a connector which is apart from the consumables container installer. Therefore, it is not necessary to change the consumables chip when the consumables container is replaced because the consumables chip is not attached to the consumables container. The invention thus reduces the consumables container costs.

This invention also provides a method for remodeling existing imaging devices which use the consumables containers having attached consumables chips into new imaging devices in which the consumables chips are installed inside a connector and are not attached to the consumables containers. The remodeled imaging devices have reduced consumables container costs.

The consumables container of the invention eliminates consumables chips and thus it has reduced manufacturing costs compared with the conventional consumables containers.

The invention is further illustrated by the combination of the embodiments and the drawings as follows.

EMBODIMENTS OF THE INVENTION

An imaging device, a method of remodeling an imaging device and a consumables container for the imaging device of the invention can be illustrated by the following embodiments.

Figure 1:
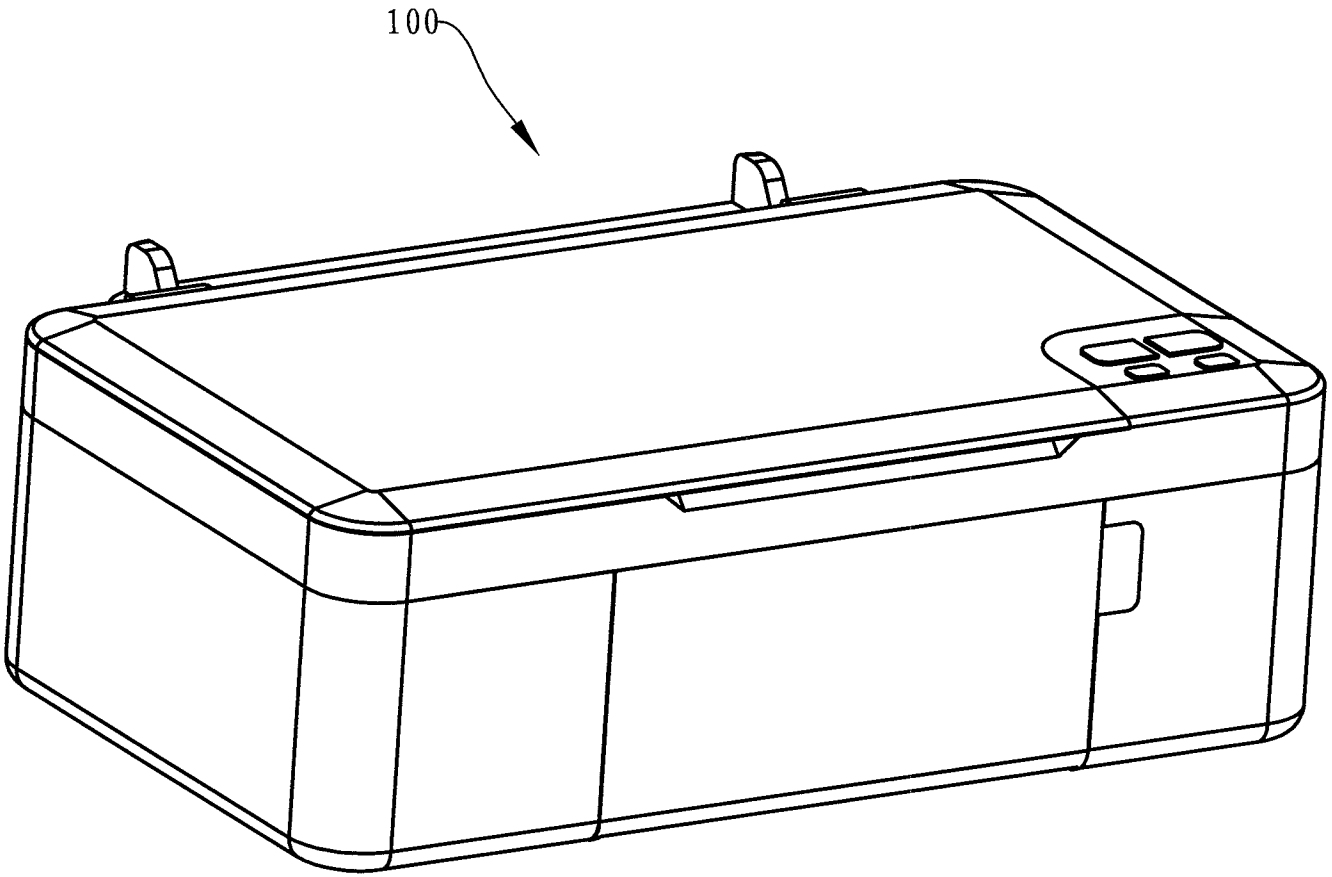
FIG. 1 is a three-dimensional view of a current inkjet printer in a retractable state.
Figure 2:
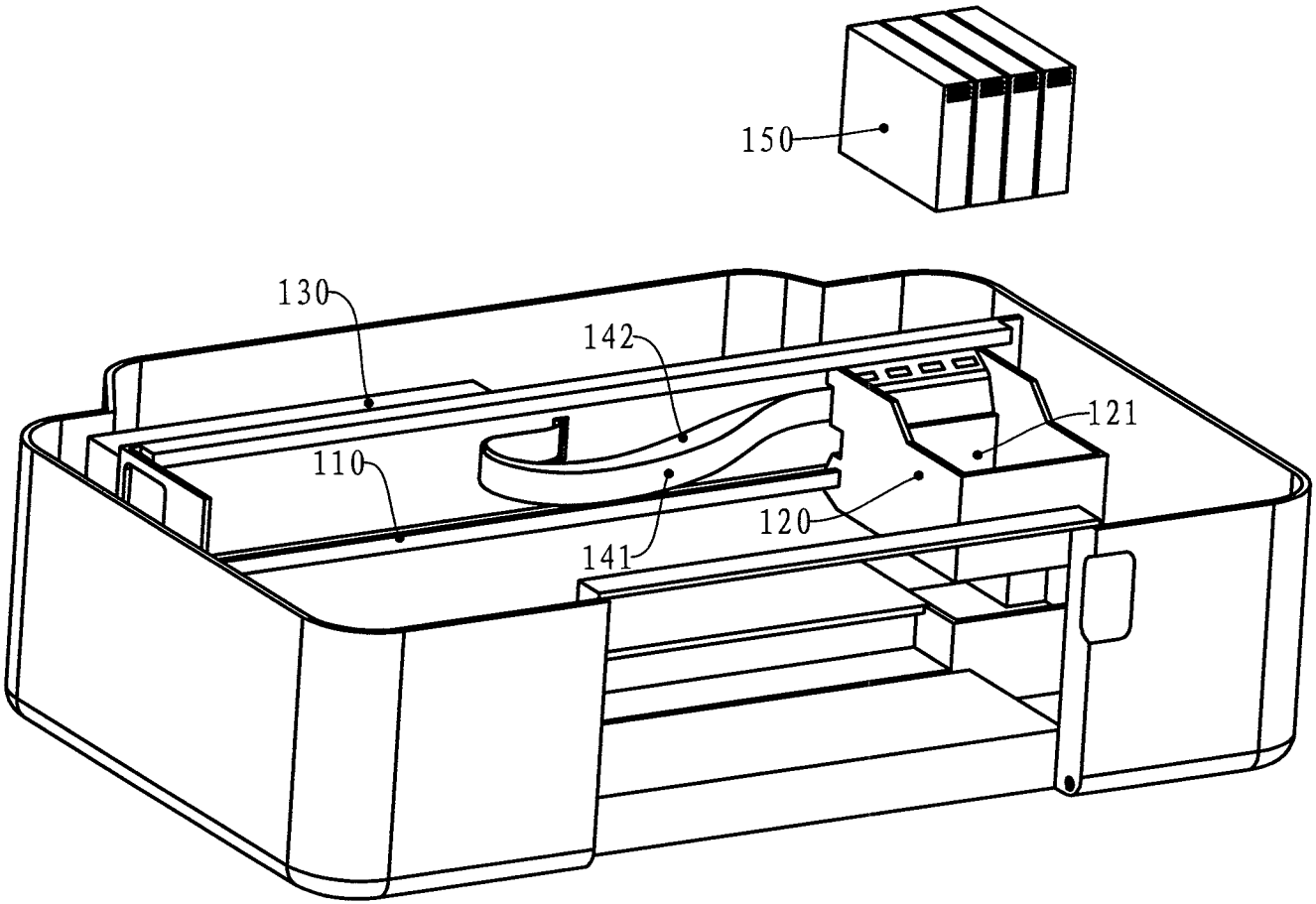
FIG. 2 is an illustrative view of the sliding bar, the printing vehicle, the ink cartridge, and other components of the inkjet printer in FIG. 1 which are relevant to the invention after the top cover and the paper platform etc. are removed.
Figure 3:
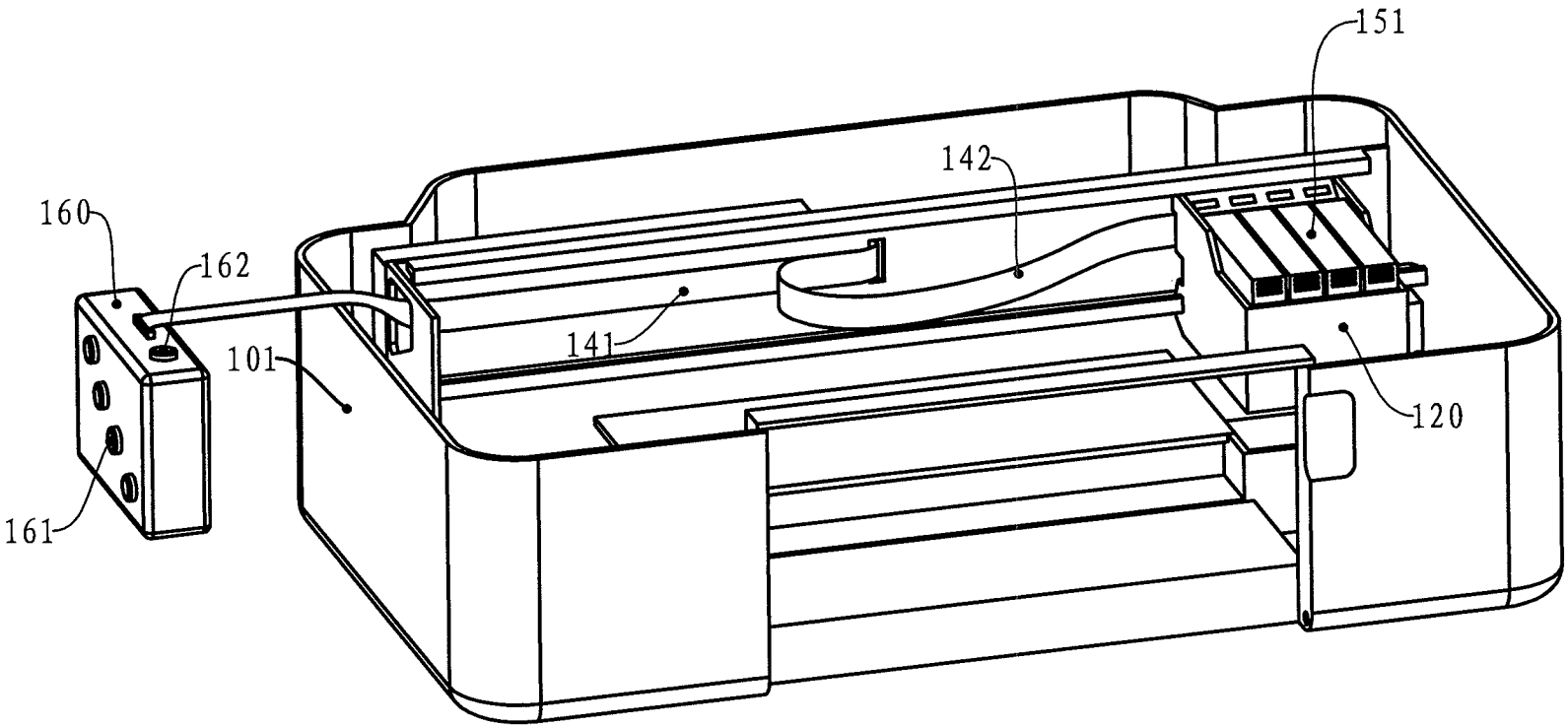
FIG. 3 is an illustrative structural view of the inkjet printer in FIG. 1 after some parts of the housing are removed.

FIG. 3 shows a method of remodeling the current inkjet printer in FIG. 1. The method comprises preparing connector box 160, installing four resetting consumables chips in box 160, disconnecting one end of each of the four electrode terminals inside printing vehicle 120 from cable 141 and connecting them with the corresponding four consumables chips inside box 160. Resetting switches 161 of the four consumables chips are placed on one surface of box 160, while lock switches 162 are placed on a different surface of box 160 to avoid mistaken resetting. In this embodiment, box 160 can be fixed on an outside wall 101 of the inkjet printer housing for convenient operation.

An embodiment of the imaging device of the invention can also be illustrated by FIG. 3. For a new inkjet printer, the box 160 and the housing 101 can be integrally designed. The box 160 can be placed inside the housing 101 so long as the resetting switches and the lock switches are placed on the housing 101 for convenient operation.

The consumables container of the invention is especially useful for such an inkjet printer which uses consumables container 151 of no consumables chip attached.

Figure 4:
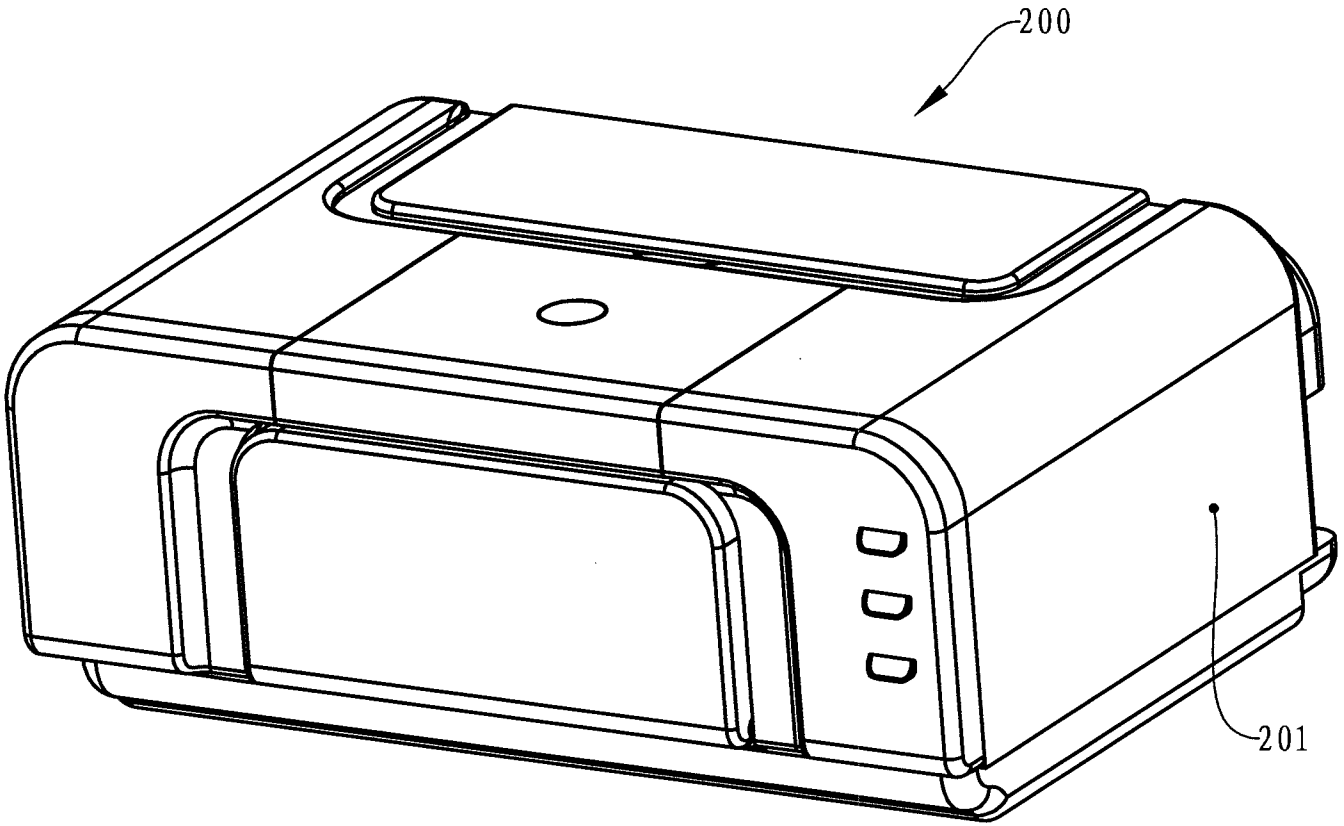
FIG. 4 is a three-dimensional view of another current inkjet printer in a retractable state.
Figure 5:
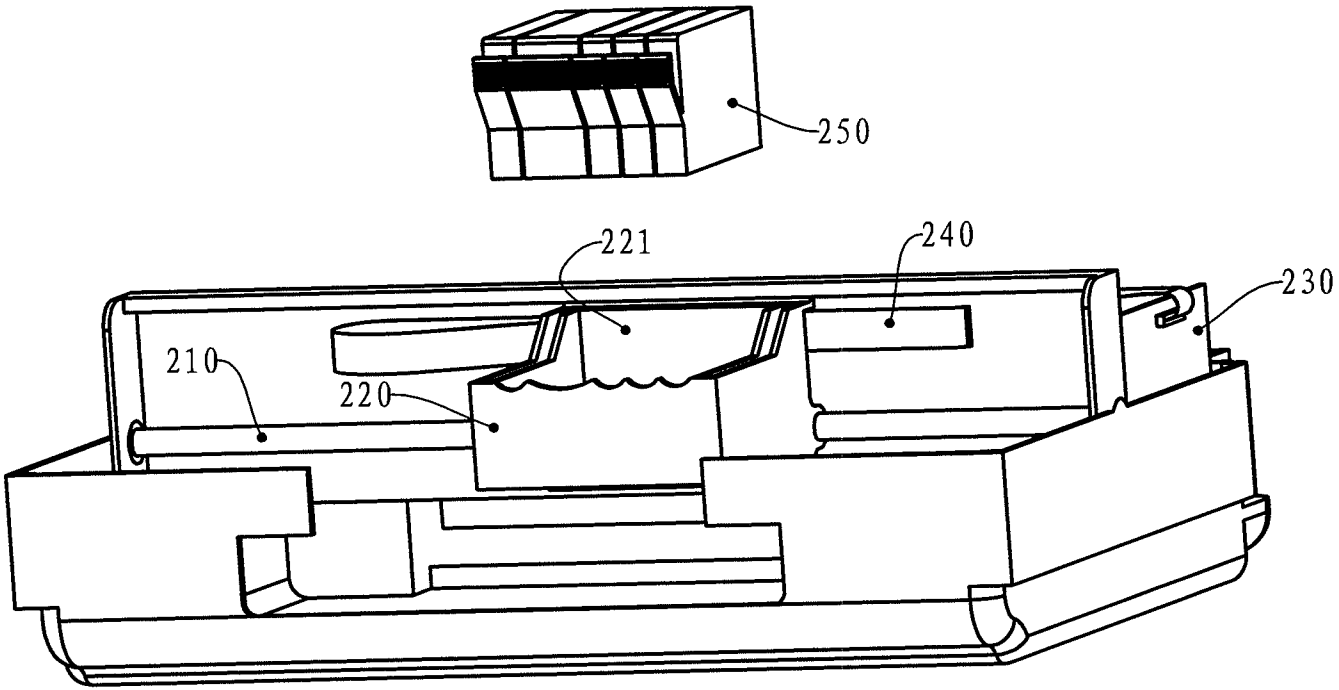
FIG. 5 is an illustrative view of the sliding bar, the printing vehicle, the ink cartridge and other parts of the inkjet printer in FIG. 4 which are relevant to the invention after the top cover, and paper platform etc. are removed.
Figure 6:
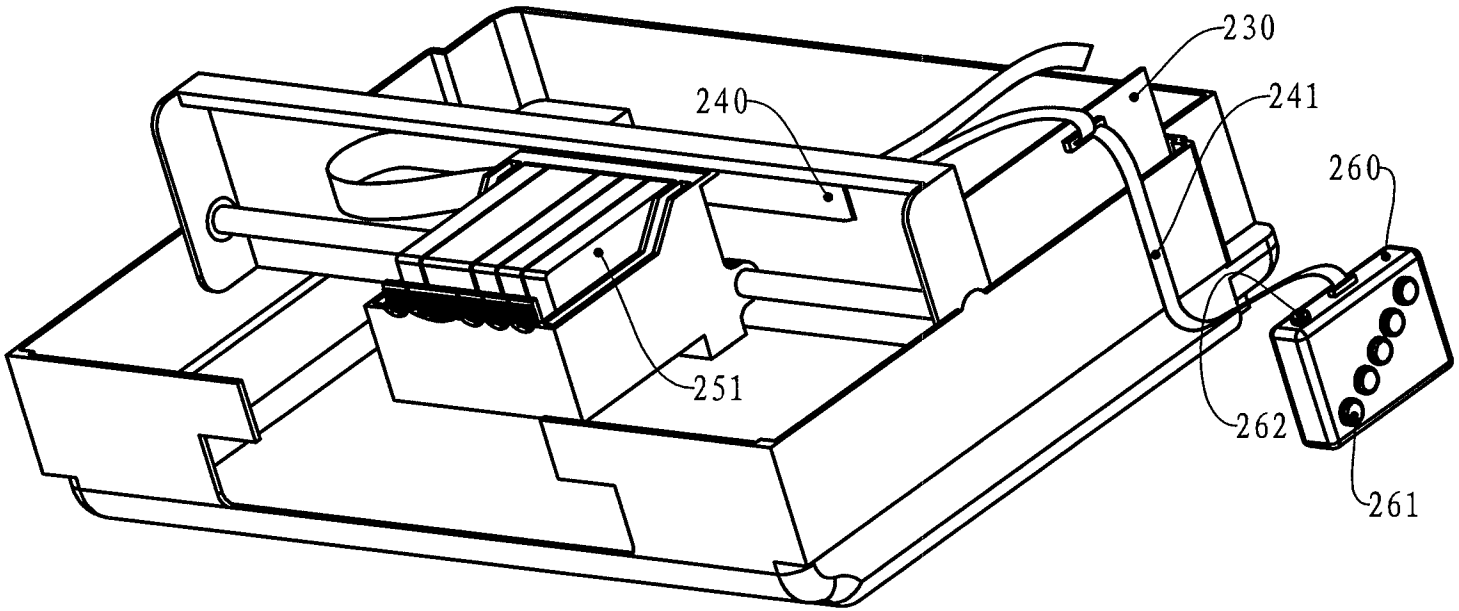
FIG. 6 is an illustrative structural view of the remodeled inkjet printer of FIG. 4 after a part of the housing is removed.

FIG. 6 shows the method of the invention for remodeling a current inkjet printer in FIG. 4. The method comprises preparing a connector box 260, installing five resetting consumables chips in the box 260, and connecting the cable 240 at the end of the master control circuit board 230 which controls the printing head with a wire which connects with the communication module. The connection manner of the wire which controls the printing head remains the same. The wire which connects with the communication module is connected with five consumables chips inside the connector box 260 via cable 241. Resetting switch 261 of the consumables chips is placed on one surface of the box 260, while the lock switch 262 is placed on a different surface of box 260 to avoid mistaken resetting. In this embodiment, box 260 can be fixed on an outside wall 201 (see FIG. 4) of the housing of the inkjet printer for convenient operation.

Another embodiment of the imaging device of the invention can be seen in FIG. 6. For a new inkjet printer, box 260 and housing 201 (see FIG. 4) can be integrally designed and box can be located inside housing 201 so long as resetting switch 261 and lock switch 262 are placed on housing 201 for convenient operation. The corresponding consumables container of the invention is especially for such an inkjet printer which uses ink cartridge 251 of no consumables chip attached. Ink cartridge 251 differs from ink cartridge 250 in that ink cartridge 251 eliminates consumables chip and thus has reduced cost.

Figure 7:
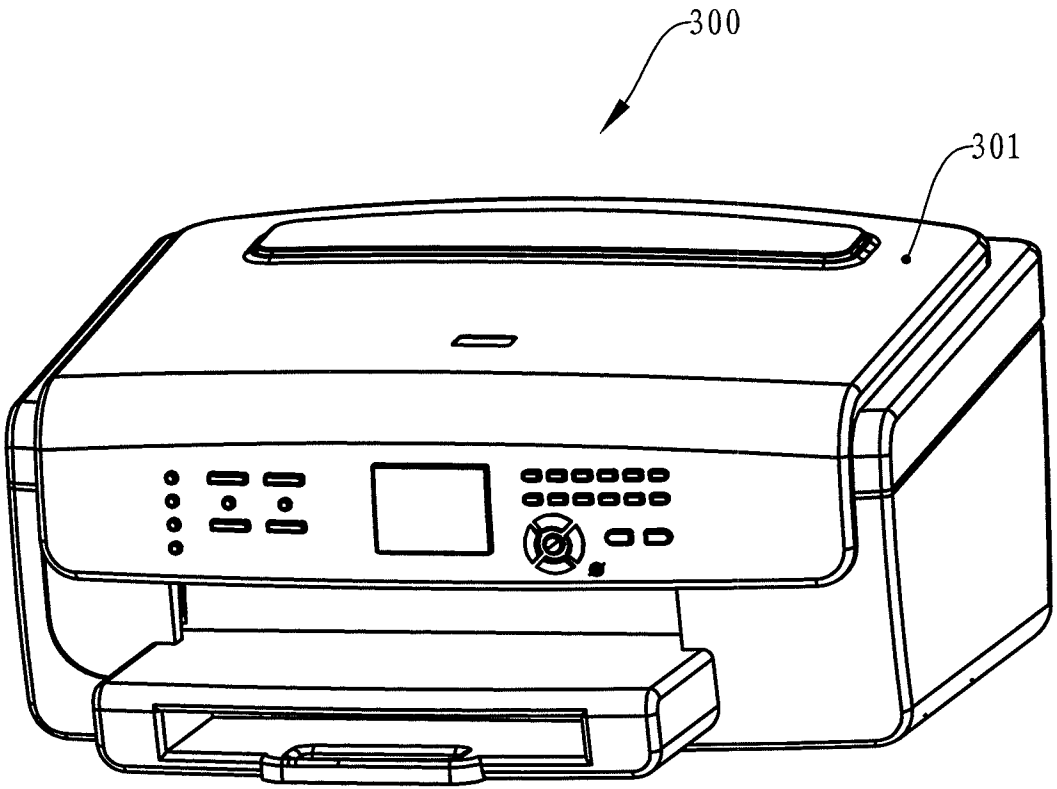
FIG. 7 is another three-dimensional view of a current inkjet printer in a retractable state.
Figure 8:
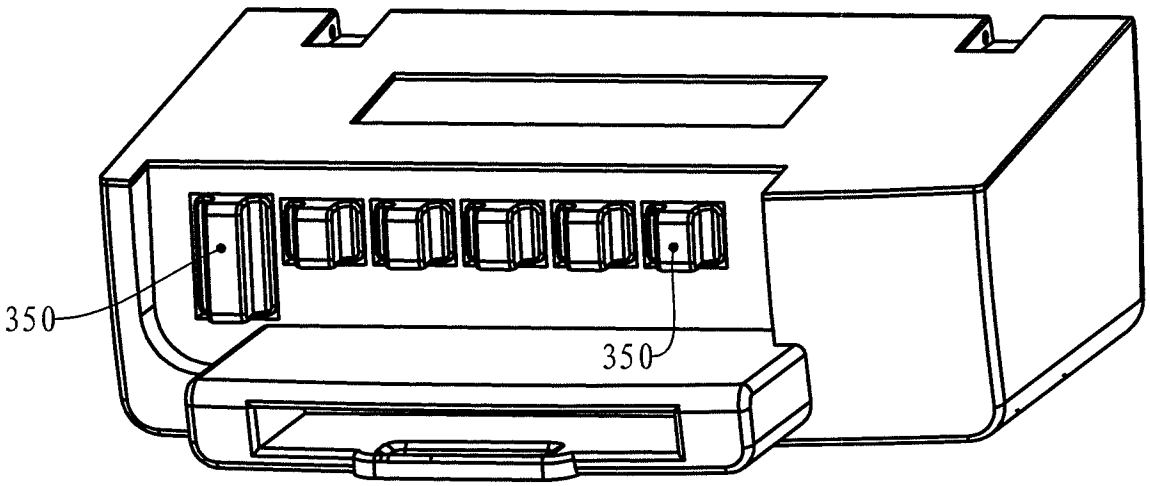
FIG. 8 is an illustrative structural view of the ink cartridge installer, the ink cartridge and other relevant parts of the inkjet printer in FIG. 7 which are relevant to this invention after the top cover is removed.
Figure 9:
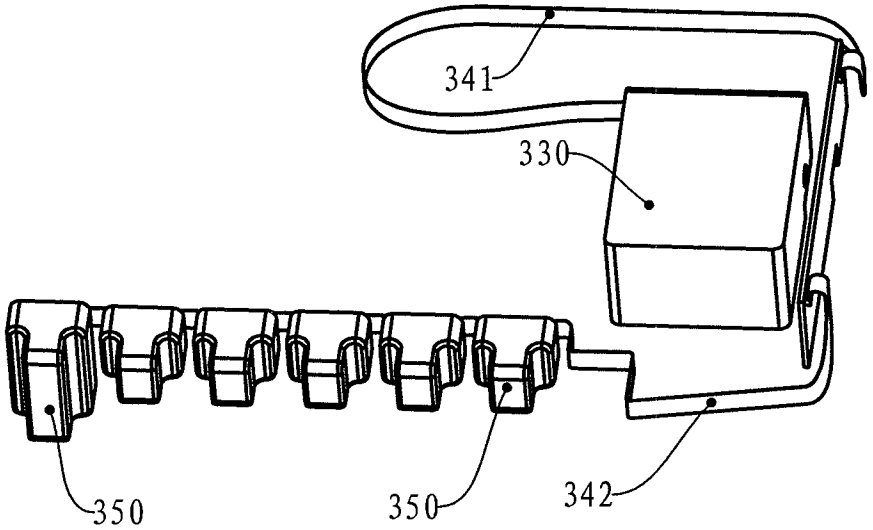
FIG. 9 is an illustrative view of the ink cartridge, the master control circuit board and the cables inside the inkjet printer in FIG. 7.
Figure 10:
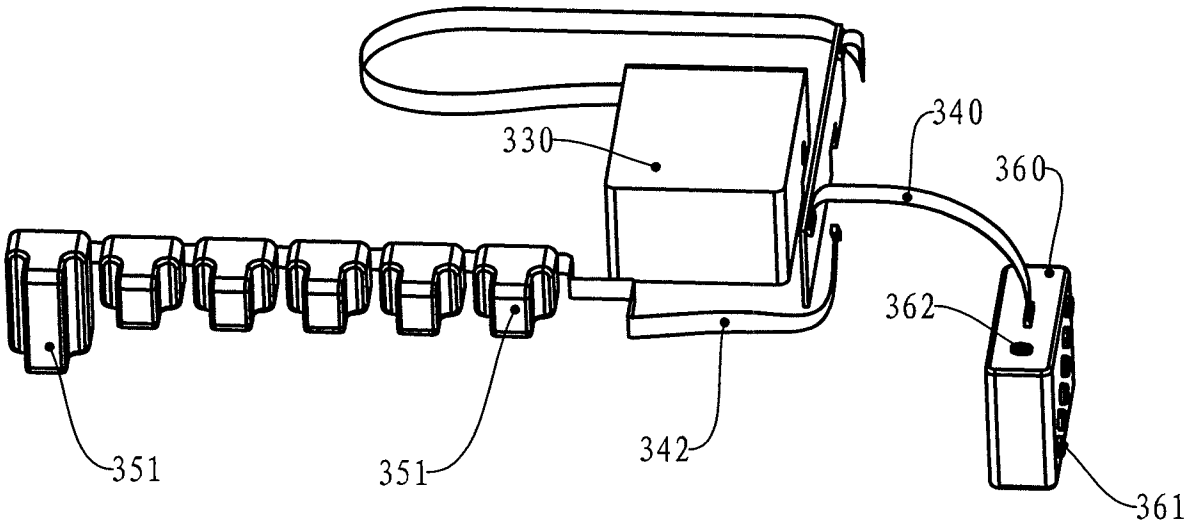
FIG. 10 is an illustrative view of the ink cartridge, the master control circuit board and the cables inside the inkjet printer in FIG. 7 after remodeling.

FIG. 10 shows the method of the invention for remodeling a current inkjet printer in FIG. 7. The method comprises preparing connector box 360, installing 6 resetting consumables chips in box 360, pulling off cable 342 from master control circuit board 330, and connecting 6 consumables chips inside box 360 with master control circuit board 330 via cable 340. Resetting switch 361 of 6 consumables chips is placed on a surface of box 360, while lock switch 362 is placed on a different surface of box 360 to prevent mistaken resetting.

Figure 11:
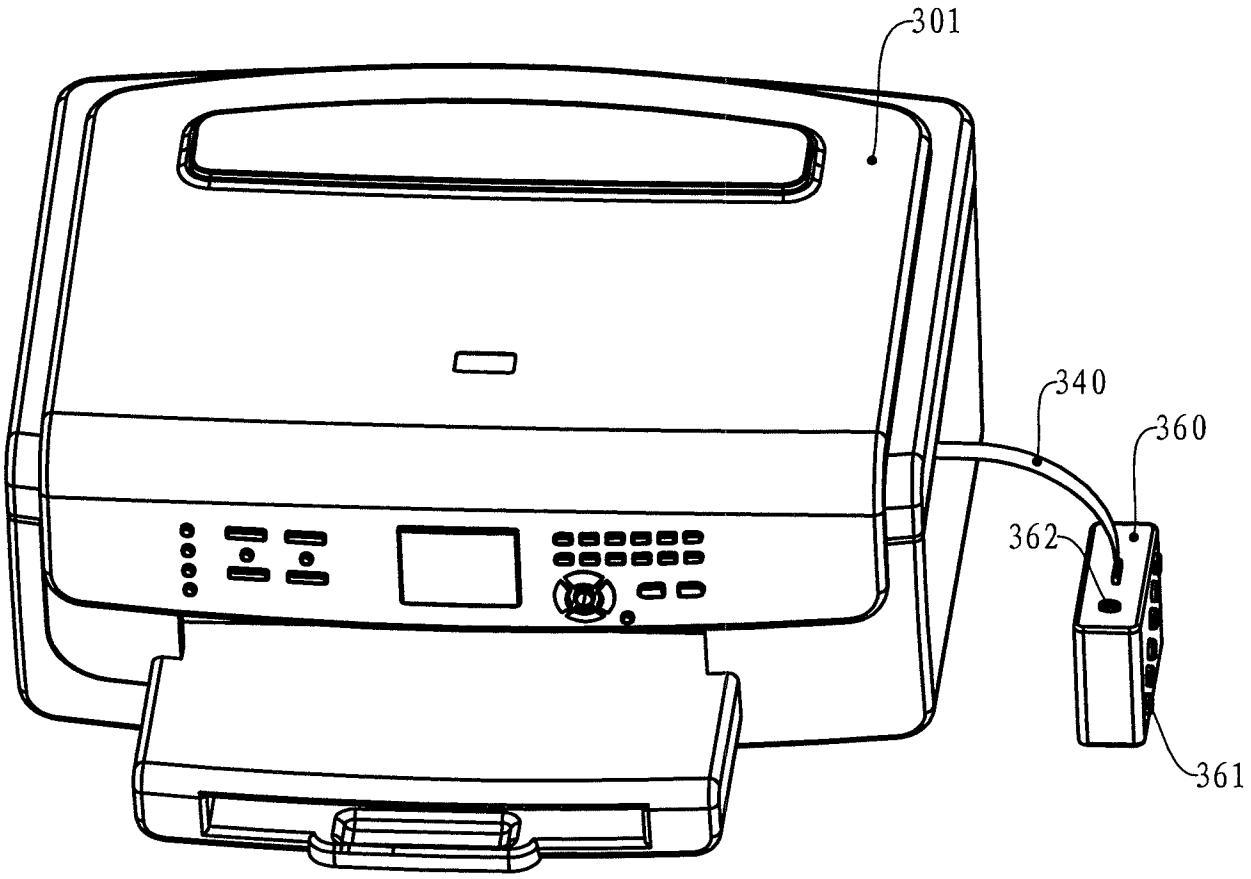
FIG. 11 is an illustrative view of the inkjet printer in FIG. 7 after remodeling and after a part of the housing is removed.

See FIG. 11. For the remodeling method in this embodiment, remodeled box 360 can be fixed on an outside wall of housing 301 of the inkjet printer for convenient operation. Cable 340 is completely inside housing 301. Box 360 can also be fixed on an inner wall of housing 301 as long as resetting switch 361 and lock switch 362 are placed on the housing for convenient operation.

Another embodiment of the imaging device of the invention can also be seen in FIG. 11. For a new inkjet printer, box 360 and housing 301 can be integrally designed and box 360 can be located inside housing 301 as long as resetting switch 361 and lock switch 362 are placed on housing 301 for convenient operation. The corresponding consumables container of this embodiment is especially designed for use in such an inkjet printer which uses ink cartridge 351 of no consumable chip attached. Ink cartridge 351 differs from ink cartridge 350 in that ink cartridge 351 eliminates the consumables chip and thus has reduced cost.

Figure 12:
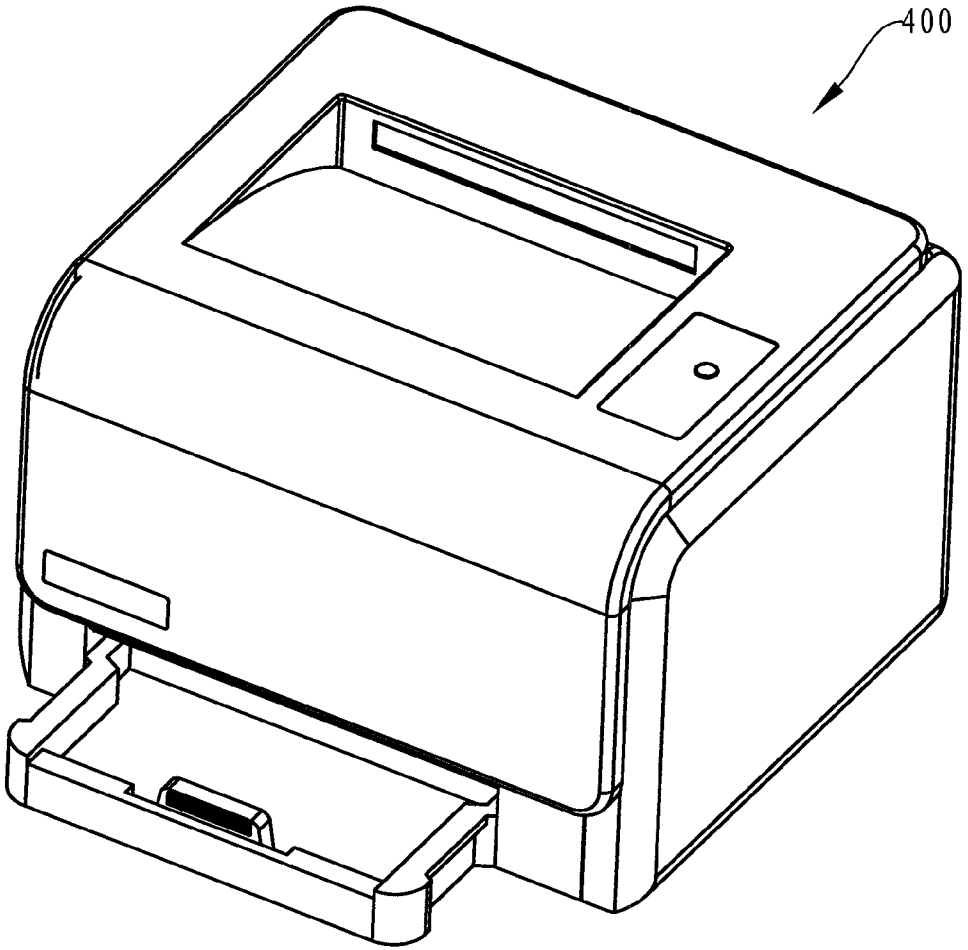
FIG. 12 is a three-dimensional view of a current color laser printer.
Figure 13:
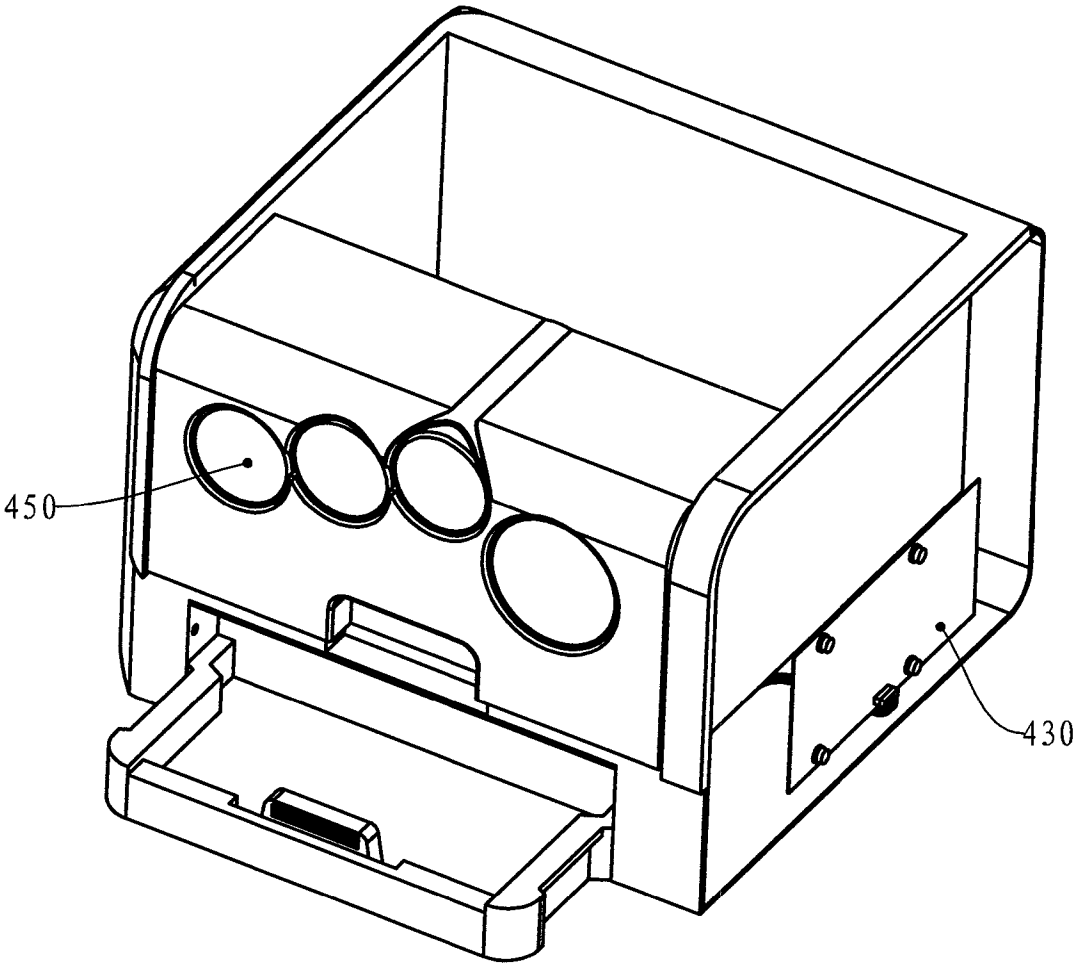
FIG. 13 is an illustrative view of the toner cartridge and the master control circuit board of the laser printer in FIG. 12 after the top cover, side wall, and some other parts are removed.
Figure 14:
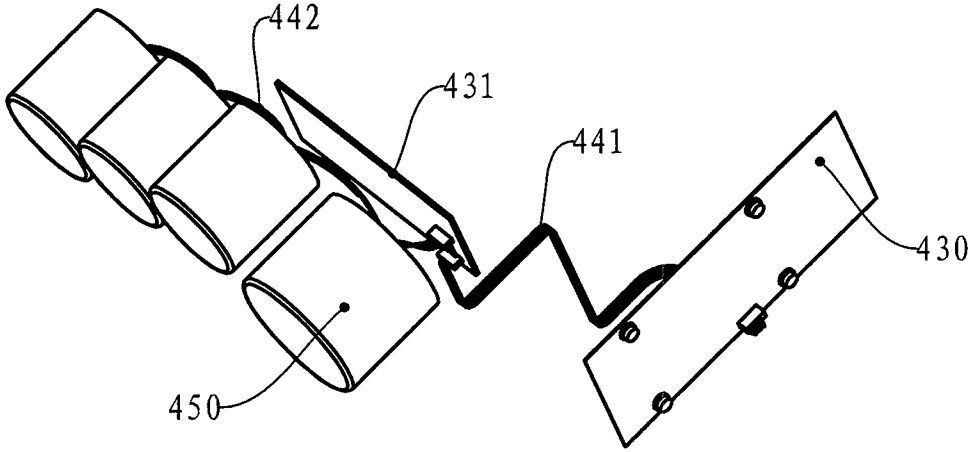
FIG. 14 is an illustrative view of the toner cartridge, the master control circuit board and the cables of the laser printer in FIG. 12.
Figure 15:
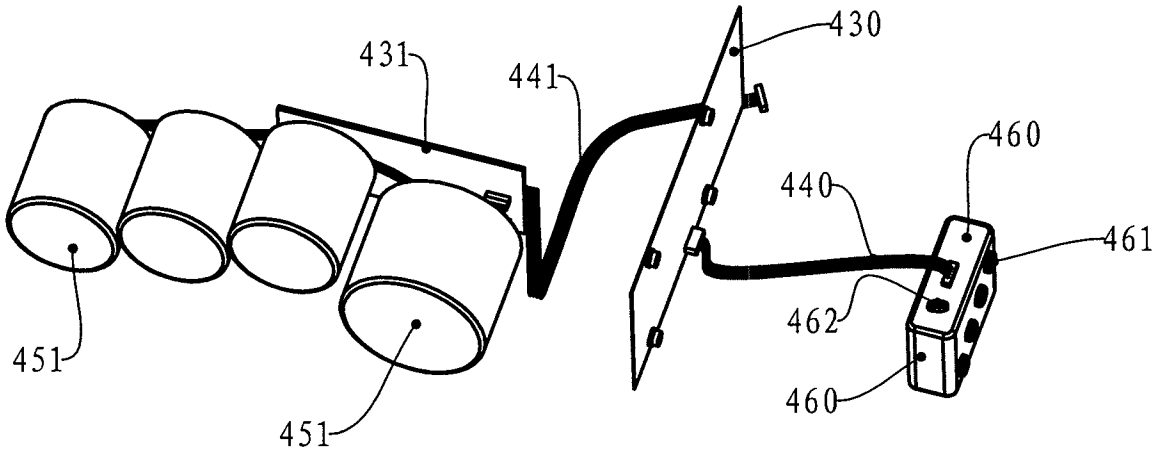
FIG. 15 is an illustrative view of the toner cartridge, the master control circuit board and the cables of the remodeled laser printer in FIG. 12.

FIG. 15 shows the method of the invention for remodeling current laser printer in FIG. 12. The method comprises preparing connector box 460, installing 4 resetting consumables chips in box 460, pulling off cable 441 from master control circuit board 430, and connecting 4 consumables chips inside box 460 with master control circuit board 430 via cable 440. Resetting switch 461 of 4 consumables chips is placed on a surface of box 460, while lock switch 462 is placed on a different surface of box 460 to prevent mistaken resetting.

Figure 16:
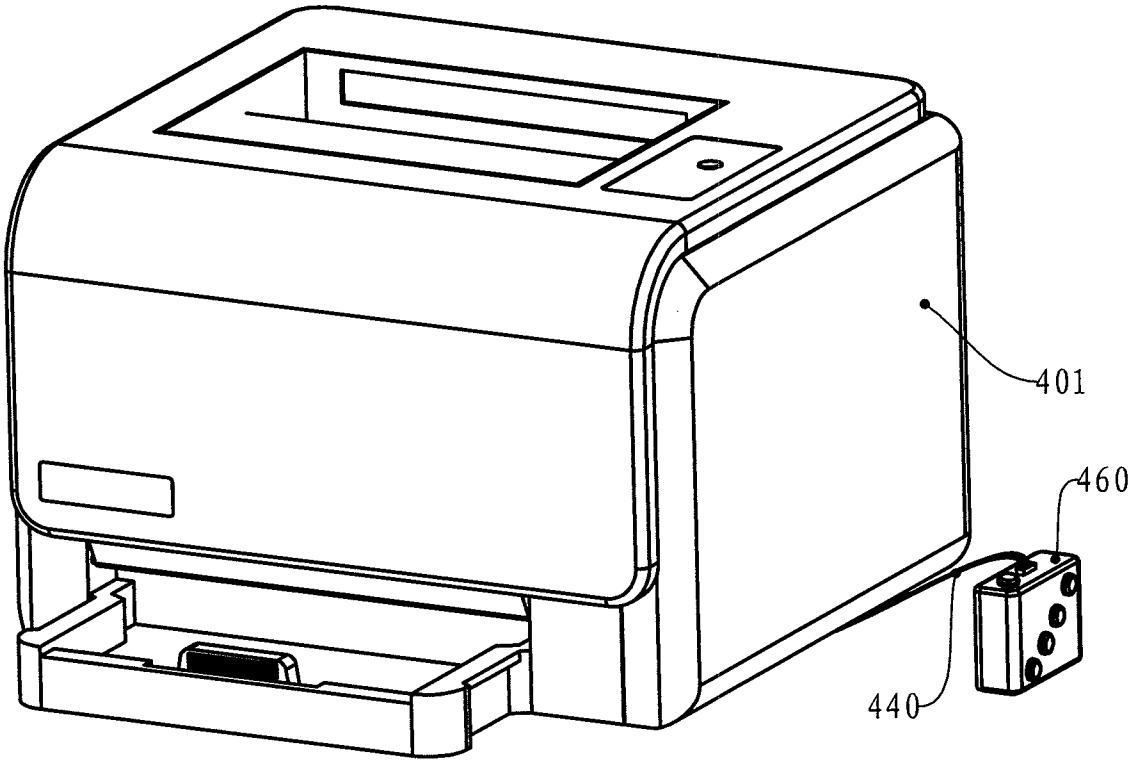
FIG. 16 is an illustrative view of the laser printer in FIG. 12 after remodeling.

See FIG. 16. For the remodeling method in this embodiment, remodeled box 460 can be fixed on an outside wall of housing 401 of the laser printer for convenient operation. Cable 440 is completely inside housing 401.

Another embodiment of the imaging device of the invention can also be seen in FIG. 16. For a new laser printer, box 460 and housing 401 can be integrally designed and box 460 can be located inside housing 401 as long as resetting switch 461 and lock switch 462 are placed on housing 401 for convenient operation. The corresponding consumables container of this embodiment is especially designed for use in such a laser printer which uses toner cartridge 451 of no consumable chip attached. Toner cartridge 451 differs from toner cartridge 450 in that toner cartridge 451 eliminates the consumables chip and thus has reduced cost.

Figure 17:
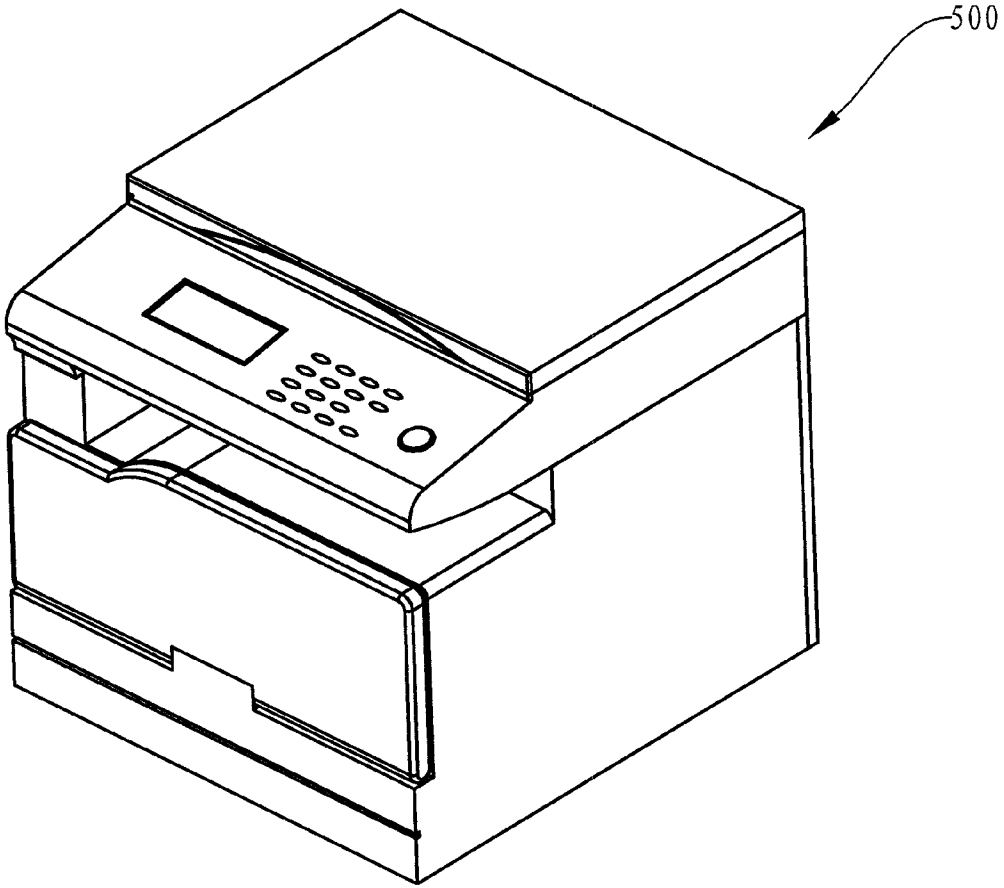
FIG. 17 is a three-dimensional view of a current copy machine.
Figure 18:
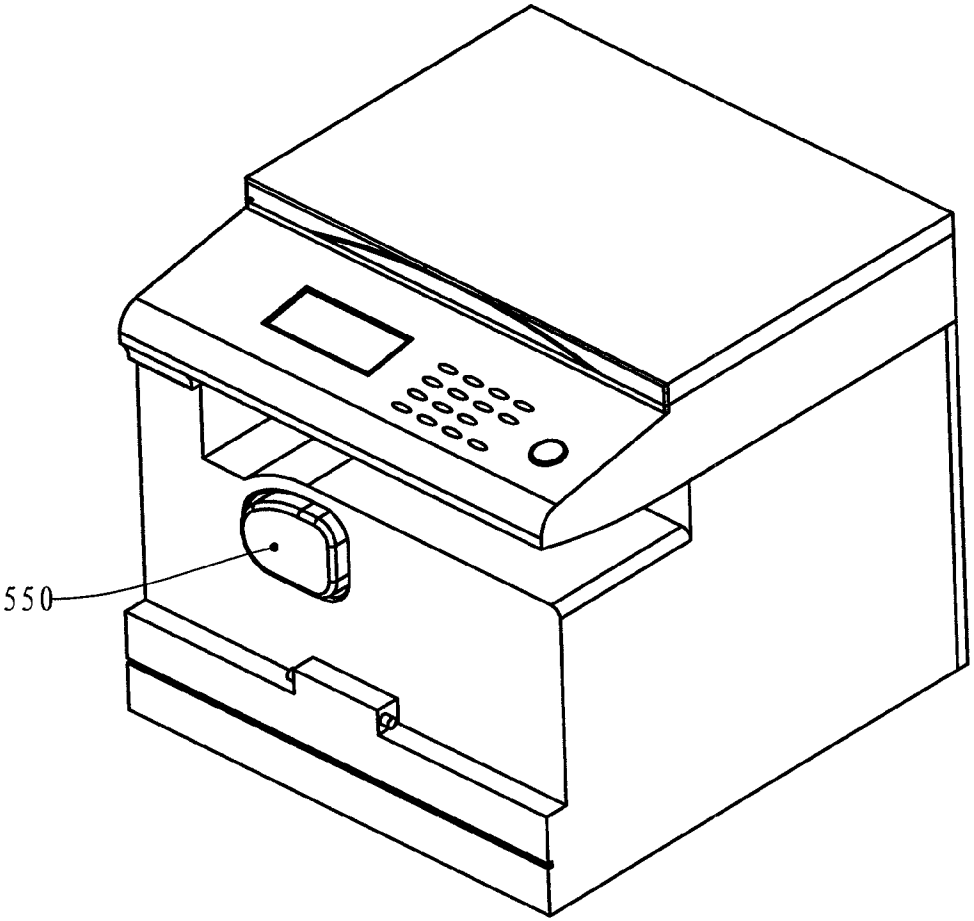
FIG. 18 is an illustrative view of the toner cartridge after the side wall of the copy machine in FIG. 17 is removed.
Figure 19:
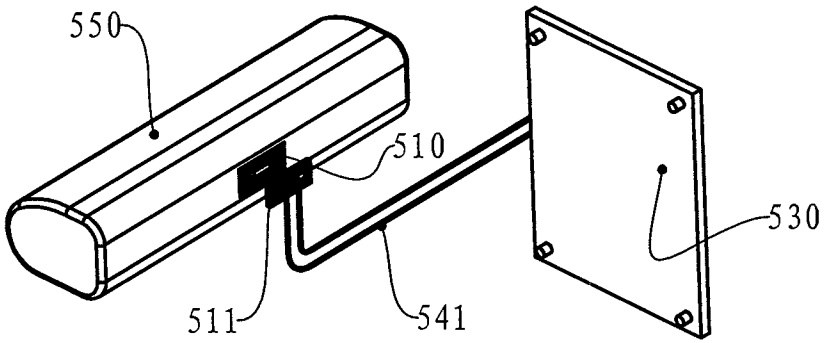
FIG. 19 is an illustrative view of the toner cartridge, the master control circuit board, the cables, and their connection of the copy machine in FIG. 17.
Figure 20:
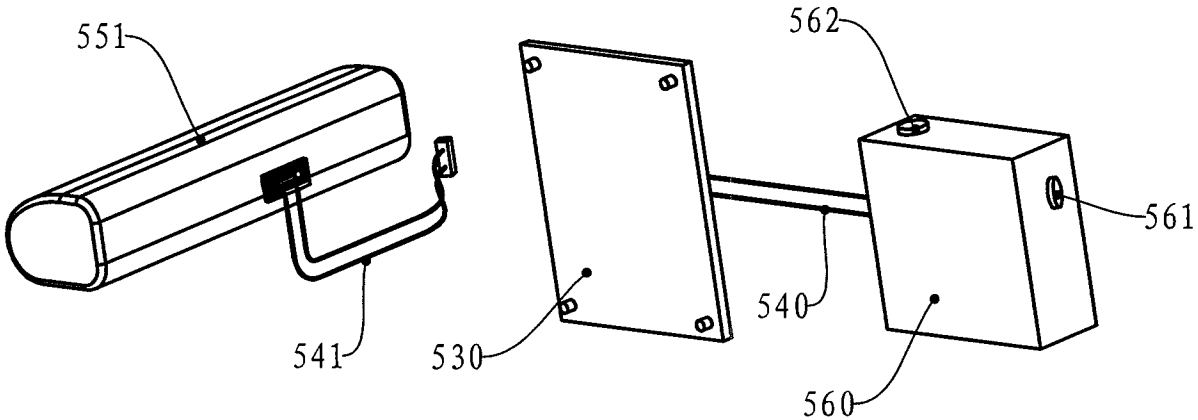
FIG. 20 is an illustrative view of the toner cartridge, the master control circuit board and the cables of the copy machine in FIG. 17 after remodeling.

FIG. 20 shows the method of the invention for remodeling a current copy machine in FIG. 17. The method comprises preparing connector box 560, installing a resetting consumables chip in box 560, pulling off cable 541 from master control circuit board 530, and connecting consumables chip inside box 560 which has a radio frequency antenna with master control circuit board 530 via the radio frequency antenna. Resetting switch 561 of the consumables chip is placed on one surface of box 560, while lock switch 562 is placed on another surface of box 560 to prevent mistaken resetting.

Figure 21:
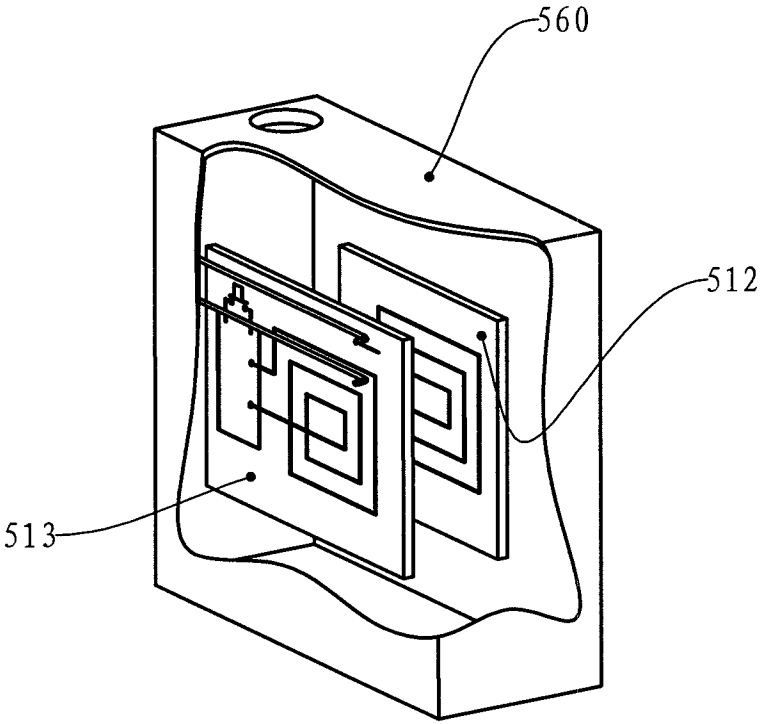
FIG. 21 is an illustrative view of the connector.

See FIG. 21. FIG. 21 shows the arrangements between consumables chip 513 inside box 560 which has a radio frequency antenna and cable 540 (see FIG. 20), i.e., they transfer information via the radio frequency antenna.

Figure 22:
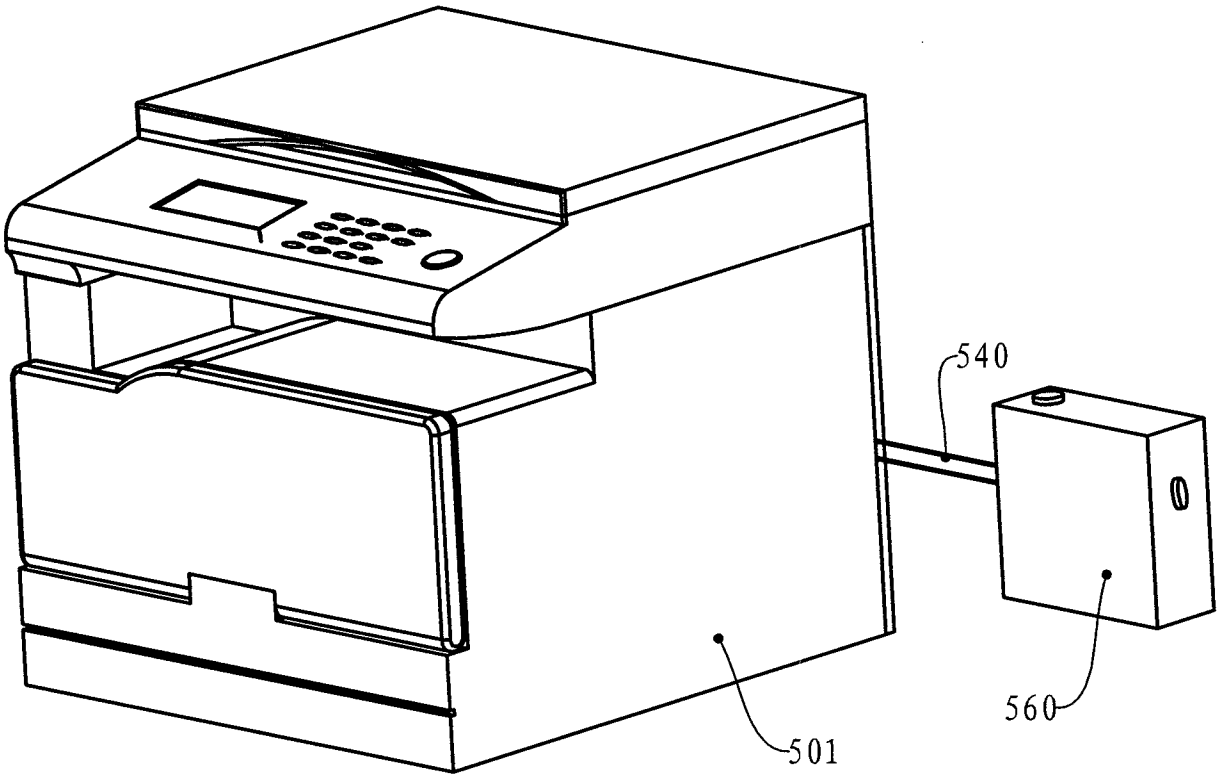
FIG. 22 is a three-dimensional view of the copy machine in FIG. 17 after remodeling.

See FIG. 22. For the remodeling method in this embodiment, remodeled box 560 can be fixed on an outside wall of housing 501 of the copy machine for convenient operation. Cable 540 is completely inside housing 501.

Another embodiment of the imaging device of the invention can also be seen in FIG. 22. For a new copy machine, box 560 and housing 501 can be integrally designed and box 560 can be located inside housing 501 as long as resetting switch 561 and lock switch 562 are placed on housing 501 for convenient operation. The corresponding consumables container of this embodiment is especially designed for such a copy machine which uses toner cartridge 551 of no consumable chip attached (see FIG. 20). Toner cartridge 551 differs from toner cartridge 550 in that toner cartridge 551 eliminates the consumables chip and thus has reduced cost.

The spirit of the invention is to change the traditional concept that every consumables container must have a consumables chip. According to this invention, the consumables chip is installed in a connector which is apart from the consumables container installer and therefore the cost of the consumables container is greatly reduced. Therefore the spirit of the invention shall not be limited by the above embodiments. Many variations and embodiments can still fall within the scope of the invention. For instance, the consumables chip can be an automatic resetting chip and thus there is no need for the resetting switch and lock switch. Also, the communication between the electrode terminal and the consumables chip can be infrared and Bluetooth, etc.

INDUSTRIAL APPLICABILITY OF THE INVENTION

This invention separates the consumables container from the consumables chip and installs the consumables chip in a connector on the housing of the imaging device. It diverges from the traditional concept that when a consumables container is changed, the consumables chip must also be changed. The invention therefore has reduced consumables container costs.

We claim:

1. A imaging device comprising:

a housing; a machine body being installed inside the housing; the machine body comprising a master control circuit board; the master control circuit board comprising a communications module; the communications module communicating with a consumables resetting chip;

a consumables container installer; one or more consumables containers being detachably installed on the consumables container installer; the consumables chip storing information relating to the consumables container;

wherein a connector is installed apart from the consumables container installer and the consumables chip which communicates with the communication module is installed in the connector;

wherein the connector comprises a box fixed on a wall of the housing, and wherein the resetting chip is installed inside the box.

2. The imaging device of claim 1, wherein a resetting switch of the resetting chip is installed on a wall of the box.

3. The imaging device of claim 1, wherein the consumables container installer is a printing vehicle; the printing vehicle is equipped with an ink supply needle; the consumables container is an ink cartridge; the ink cartridge has an ink supply port; the ink cartridge is detachably installed inside the printing vehicle so that the ink supply port and the ink supply needle have fluid connection.

4. The imaging device of claim 1, wherein the consumables container installer is a printing vehicle; the consumables container is an ink cartridge; the ink cartridge has a printing head; and the ink cartridge is detachably installed inside the printing vehicle.

5. The imaging device of claim 1, wherein the consumables container installer is on the machine body; the consumables container is an ink cartridge; and the ink cartridge is detachably installed on the consumables container installer.

6. A method for remodeling an imaging device; said imaging device comprising:

a housing; a machine body being installed inside the housing; the machine body comprising a master control circuit board; the master control circuit board comprising a communications module which communicates with a consumables resetting chip; and a consumables container installer; one or more consumables containers being detachably installed on the consumables container installer; the consumables chip storing information relating to the consumables container and being fixed on an outside wall of the consumables container; and the consumables container being equipped with an electrode terminal which is electrically connected with the communications module;

the method comprising:

installing a connector in a place apart from the consumables container installer, the connector comprising a box fixed on a wall of the housing;

breaking the electrical connection between the communications module and the electrode terminal; and installing the consumables chip in the connector which communicates with the communications module.

7. The method of claim 6, wherein a resetting switch of the resetting chip is placed on a wall of the box or on a wall of the housing.

8. The method of claim 6, wherein the consumables container installer is a printing vehicle; the printing vehicle is equipped with an ink supply needle; the consumables container is a ink cartridge; the ink cartridge has an ink supply port; and wherein the ink cartridge is detachably installed inside the printing vehicle so that the ink supply port and the ink supply needle have a fluid connection.

9. The method of claim 6, wherein the consumables container installer is a printing vehicle; the consumables container is an ink cartridge; the ink cartridge has a printing head; and wherein the ink cartridge is detachably installed inside the printing vehicle.

10. The method of claim 6, wherein the consumables container installer is placed on the machine body; the consumables container is an ink cartridge; and the ink cartridge is detachably installed on the consumables container installer.

11. An imaging device comprising:

a consumables container installer configured to have a consumables container detachably installed thereon;

a housing;

a machine body installed inside the housing;

a master control circuit board installed in the housing, the master control circuit having; a communications module that communicates with a consumables chip that stores information relating to the consumables container; and a box arranged on a wall of the housing installed in a place apart from the consumables container installer and having a connector, wherein the consumables chip is coupled to the connector and is configured to communicate with the communications module, and wherein the consumables chip is a resetting chip.

12. The consumables container of claim 11, wherein a resetting switch of the resetting chip is on an accessible wall of the box or the housing.

13. The consumables container of claim 11, wherein the consumables container installer is a printing vehicle; the printing vehicle has an ink supply needle; the consumables container is an ink cartridge; the ink cartridge has an ink supply port; and wherein the ink cartridge is detachably installed inside the printing vehicle so that the ink supply port and the ink supply needle have a fluid connection.

14. The consumables container of claim 11, wherein the consumables container installer is a printing vehicle; the consumables container is an ink cartridge; the ink cartridge has a printing head; and the ink cartridge is detachably installed inside the printing vehicle.

15. The consumables container of claim 11, wherein the consumables container installer is installed on the machine body inside the housing; and the consumables container is an ink cartridge which is detachably installed on the consumables container installer.

* * * * *